United States Patent [19]

Rosenband

[11] 4,106,630

[45] Aug. 15, 1978

[54] STORAGE RACK ASSEMBLY

[75] Inventor: Phillip Rosenband, Hammond, Ind.

[73] Assignee: Parsteel Products Company, Inc., Chicago Heights, Ill.

[21] Appl. No.: 791,689

[22] Filed: Apr. 28, 1977

[51] Int. Cl.[2] ..... A47F 5/10

[52] U.S. Cl. ..... 211/191; 211/208; 248/223.1; 403/231

[58] Field of Search ..... 211/190, 192, 187, 182, 211/191, 208; 403/353, 316, 254, 231; 108/111; 248/222.4, 223.1, 243, 223.2

[56] References Cited

U.S. PATENT DOCUMENTS

| | | | |
|---|---|---|---|
| 1,254,094 | 1/1918 | Vogt | 248/243 |
| 1,288,010 | 12/1918 | Isaac | 248/243 X |
| 3,045,834 | 7/1962 | Seiz | 211/191 |
| 3,330,229 | 7/1967 | Ferdinand et al. | 211/187 X |
| 3,392,848 | 7/1968 | McConnell et al. | 248/223.1 X |
| 3,846,944 | 11/1974 | Lambert | 211/187 X |
| 3,862,691 | 1/1975 | Mori et al. | 108/111 X |
| 3,986,318 | 10/1976 | McConnell | 211/192 X |

FOREIGN PATENT DOCUMENTS

| | | | |
|---|---|---|---|
| 1,460,886 | 10/1966 | France | 108/111 |
| 285,256 | 1/1965 | Netherlands | 211/191 |
| 379,078 | 8/1964 | Switzerland | 211/191 |

*Primary Examiner*—Roy D. Frazier
*Assistant Examiner*—Robert W. Gibson, Jr.
*Attorney, Agent, or Firm*—Marvin N. Benn & Assoc. Ltd.

[57] ABSTRACT

A storage rack assembly comprising a plurality of L shaped corner posts each having a plurality of spaced apart openings in each wall thereof for interlocking with mating tabs struck from near one end of each of a plurality of beams. Each corner post opening has a central area wider than its opposite ends, which ends lie on a line coaxial with the elongate axis of a post. Each tab comprises a central portion spaced from the beam, two opposed connecting arms extending outwardly from the central portion coaxial with the elongate axis of the beam and transversely of the connecting arms. Upon assembly, the elongate axis of the beam and post are arranged in perpendicular relationship enabling a tab to be inserted through the wider central area of an opening and then moved downwardly to provide a three point contact defined by the opposed ears extending over and contacting one face of one post wall and by one connecting arm engaging and bearing against one end of the opening.

17 Claims, 11 Drawing Figures

STORAGE RACK ASSEMBLY

BACKGROUND OF THE INVENTION

1. Field of the Invention

The present invention relates to storage rack assemblies and particularly storage rack assemblies of the vertically adjustable type.

2. Description of the Prior Art

Heretofore various storage rack assemblies and constructions have been proposed which include four or more posts of sheet metal or the like and a plurality of beams which are interconnected with the post by means of interconnecting tabs and slots to form a box shaped framework with the beams being aligned in spaced apart planes and having a horizontally extending wall portion for supporting a shelf panel thereon. Such assemblies provide for the interconnection of the frame members, i.e., posts and beams without the use of fasteners. Examples of such previously proposed storage rack assemblies are disclosed in the following U.S. Patents:

| U.S. Pat. No. | Patentee |
|---|---|
| 3,045,834 | Seiz |
| 3,342,247 | Berend |
| 3,637,087 | Denny |
| 3,733,755 | Butler |
| 3,846,944 | Lambert |
| 3,862,691 | Mori et al. |

The storage rack assembly of the present invention differs from the previously proposed rack assemblies in the construction and interaction of the mating, interconnecting and interlocking openings and tabs as will be explained in more detail below. More specifically, the particular construction of the mating, interconecting and interlocking openings and tabs utilized in the beams and posts of the storage rack assembly of the present invention provide for a stable locking mechanism with three point contact between the tab on each beam and the adjacent post it is connected to. Also the beams and posts are easy and inexpensive to manufacture and assemble.

SUMMARY OF THE INVENTION

According to the present invention there is provided in a storage rack assembly comprising at least one post of sheet metal or the like having at least one supporting wall with a front face and a back face, at least one opening in said supporting wall, at least one, one-piece beam of sheet metal or the like having an elongate wall portion with a front face and a back face and at least one load carrying tab struck from the wall portion adjacent one end of said beam and projecting from one face thereof, said tab being received in said opening with said beam extending transversely of said post, with the improvement residing in said opening being wider in the central area thereof between opposite ends of said opening which ends lie on a line which is co-axial with the elongate axis of said post, said tab having a central portion spaced outwardly from said one face of said wall portion and a connecting portion extending between said central portion and said wall portion of said beam, said central portion having at least one edge extending outwardly therefrom and transversely of said connecting portion and, when said beam is connected to said post, said central portion is received through said central area of said opening and then moved in a line co-axial with the elongate axis of said post to place said connecting portion in one of said ends of said opening with said edge positioned over one face of said wall of said post.

DESCRIPTION OF THE PREFERRED EMBODIMENTS

Figure 1:
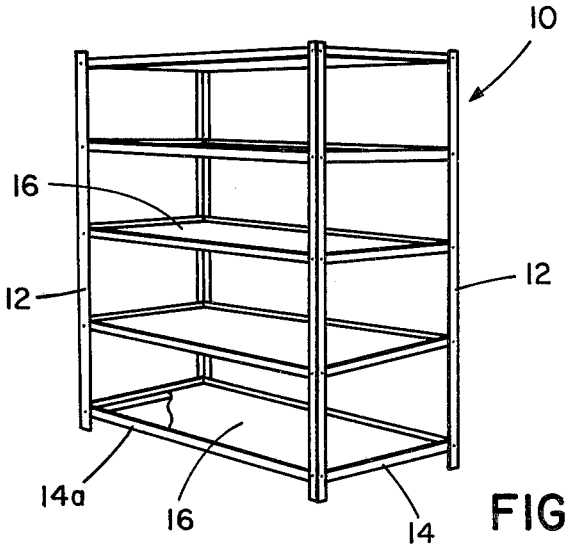
FIG. 1 is a perspective view of a storage rack assembly constructed according to the teachings of the present invention.
Figure 2:
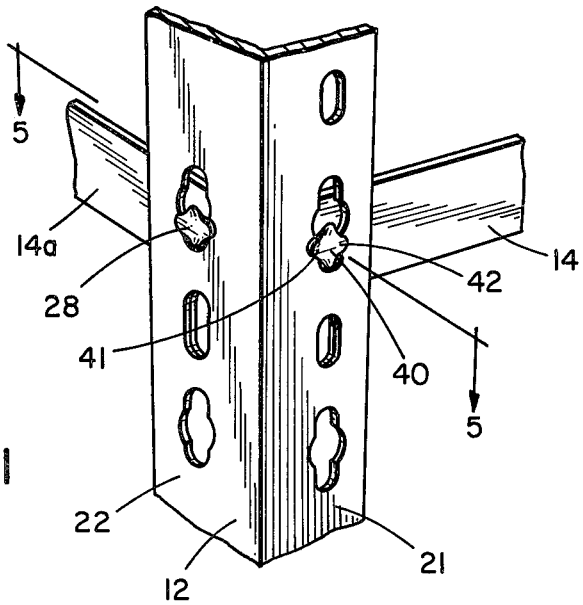
FIG. 2 is a fragmentary enlarged perspective view of one corner of the assembly shown in FIG. 1 and showing the connection between a post and two beams.

Referring now to the drawings in greater detail, a storage rack assembly 10 constructed in accordance with the teachings of the present invention is shown in FIG. 1. The assembly 10 includes four corner posts 12 interconnected by a plurality of beams 14. In the illustrated embodiment, some of the beams 14 are longer than others and the longer beams are identified by the reference numeral **14*a*. As will be described in greater detail below, the beams 14 and 14*a* are the same except for the difference in length. That is to say the configuration, cross sections and ends of all the beams 14 and 14*a* are identical although the beams 14 are shorter than the beams 14*a***.

In the illustrated embodiment five shelves or racks are provided, each rack or shelf being defined by two short beams 14 and two long beams **14*a* interconnected between the four posts as shown in a shelf panel 16 supporting by and situated between the beams 14 and 14*a*. As will be explained in greater detail below, the space between the shelves can be adjusted as desired and the storage rack assembly can include any number of shelves desired, the number being limited only by the length of the corner posts 12** and the desired spacing between shelves.

Referring now to FIGS. 2–6, in the embodiment illustrated therein, the corner post 12 includes first and second supporting walls 21 and 22. As shown, the walls 21 and 22 abut each other at right angles and are integral with each other along the abutting edges thereof in an L-shaped configuration. In this embodiment, the walls 21 and 22 are substantially identical to each other and have substantially the same width. Also each supporting wall 21 and 22 has a front face on the outer side of the L and a back face on the inner side of the L.

Figure 3:
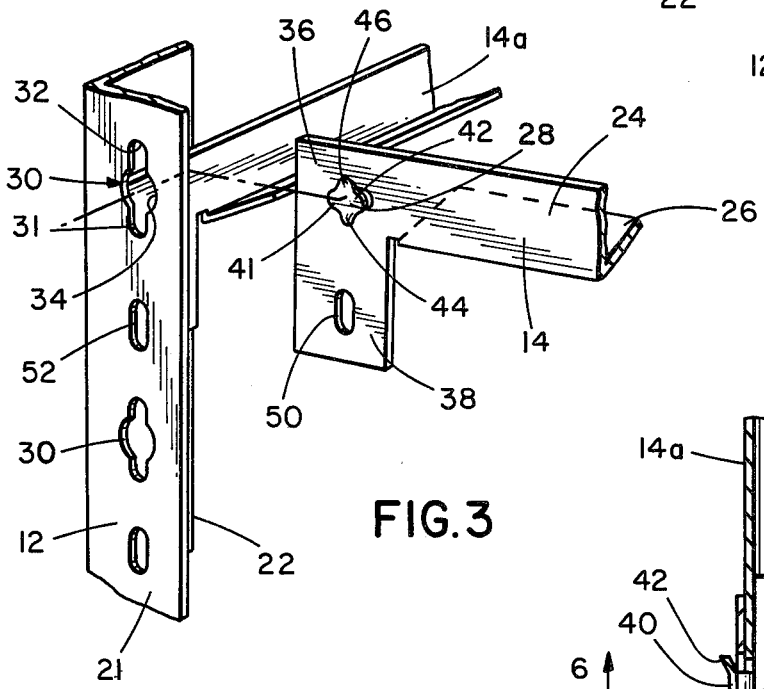
FIG. 3 is a fragmentary perspective view of the corner shown in FIG. 2 but rotated 90° and with one beam shown in exploded relationship to the post.

As best shown in FIG. 3, each of the beams 14 and 14*a* has a wall portion 24 which has a front face and a back face and which lies in a generally vertical plane, and a shoulder, flange or shelf forming wall portion 26 which extends at 45° from the wall portion 24, and is integral with an edge of the wall portion 24.

Figure 4:
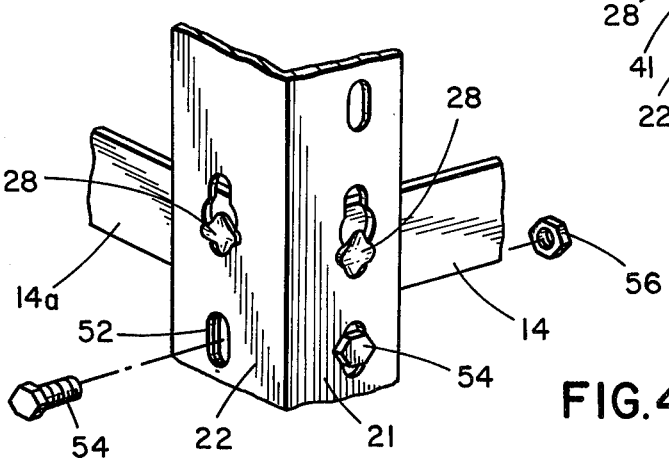
FIG. 4 is a fragmentary perspective view similar to FIG. 2 and showing the use of fasteners received through aligned holes in the beams and post to provide additional securement between the beams and post.
Figure 7:
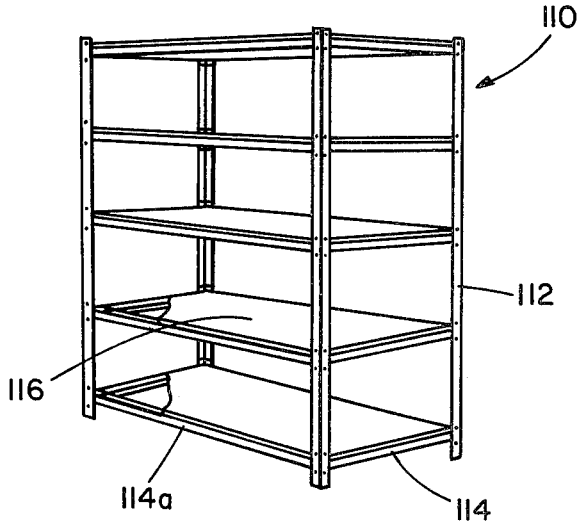
FIG. 7 is a perspective view of another storage rack assembly constructed in accordance with the teachings of the present invention.

In accordance with the teachings of the present invention, the beams 14 and 14*a* are interconnected with the post 12 by means of mating tabs 28 and openings 30 on each beam 14 and 14*a* and post 12, respectively. As shown the openings 30 are formed in each of the supporting walls 21 and 22 and are spaced apart along the length of each wall 21 and 22 a predetermined distance. Also, as best shown in FIGS. 3 & 4, each opening 30 in one supporting wall 21 is aligned with a similar opening 30 in the adjacent supporting wall 22 so that the beams 14 and 14*a* can be mounted in alignment with each other on the post 12 to which they are attached so as to form a shelf panel supporting framework. Additionally, in this embodiment, the openig 30 in each wall 21 and 22 are spaced approximately the same distance from the junction between the walls 21 and 22, except opening 30 in the wall 22 which is approximately $\frac{1}{8}$ inch distance further from the junction between the walls 21 and 22 than opening 30 in wall 21.

Each opening 30 is generally elongate having opposed, slot shaped rounded ends 31 and 32 which lie on a line coaxial with the elongate axis of the post 12. Also each opening 30 has a wider, i.e., generally circular, portion 34 in the central area thereof. With this configuration of the opening 30, one of the tabs 28 adjacent the end of one of the beams 14 or 14*a* easily can be inserted through the wider portion 34 and then moved toward one of the ends 31 or 32 of the opening 30. Obviously, the tab 28 will be moved into the lower of the two ends of the opening 30 and, in the illustrated embodiment, this is the end 31 of the opening 30.

In the embodiment illustrated in FIGS. 1-6, each beam 14 and 14*a* has an end portion 36 which is integral with the wall portion 24 and which has a depending flange 38. The tab 28 is struck from the front face of the end portion 36 of wall portion 24 above the flange 38.

Figure 6:
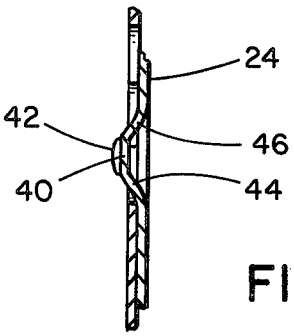
FIG. 6 is a fragmentary sectional view taken along line 6—6 of FIG. 5.

In accordance with the teachings of the present invention each tab 28 has a central portion 40 which is spaced outwardly from the front face of the wall portion 24 and which has two opposed edges or locking ears 41 and 42 extending outwardly therefrom. Further, the tab 28 includes a connecting portion extending between the central portion 40 and the front face of wall portion 24 of the beam 14. The connecting portion is defined by two arms 44 and 46 which are best shown in FIG. 6, which extend outwardly from the wall portion 24 toward each other and to the central portion 40 and which have a lateral extent less than the lateral extent of the central portion 40 with the opposed ears 41 and 42 and less than the width of the slot shaped rounded ends 31 and 32 of the opening 30 to facilitate insertion of one of the arms 44 or 46 therein.

As shown in FIG. 3, when fastening a beam 14 or 14*a* to a post 12, the central portion 40 of the tab 28 with opposed ears 41 and 42 is inserted through the wider central area 34 of the opening 30. Then, the beam 14 is moved downwardly to bring the central portion 40 over the rounded end 31 with the ears 41 and 42 extending over the front face of the supporting wall 21 and in contact therewith. At the same time, the arm 44 of the connecting portion is brought into contact with the rounded edge of the end 31 of the opening 30. In this way a three point contact is made between the tab 28 and the supporting wall 21 of the post 12. These three points of contact are identified by the point of contact between ear 41 and the front face of the supporting wall 21, the contact between the ear 42 and the front face of the supporting wall 21, and the contact between the connecting arm 44 and the rounded end 31 of the slot 30. In this way a firm strong contact is made between the connecting tab 28 and the supporting wall 21.

In addition to the interlocking between the tabs 28 and the posts 12 by means of the openings 30, the beams 14 and 14*a* and the supporting walls 21 and 22 of the post 12 are all provided with holes therein which are adapted to be aligned and mate with each other when the tabs 28 are received in the openings 30 and locked in place and then to receive fasteners therein. In this respect, the flange 38 of the beam 14 has an oval shaped hole 50 therein which is adapted to be aligned with one of a plurality of oval shaped holes 52 formed in and along the length of each supporting wall 21 and 22. As shown each oval shaped hole 52 is situated between and aligned with two of the openings 30.

Once the tabs 28 are secured in place within one of the openings 30, a fastener such as a bolt 54 can be inserted through the aligned mating holes 50 and 52 and secured in place by a nut 56. In this way, additional securement and locking of the beams 14 and 14*a* to the post 12 is obtained.

Figure 5:
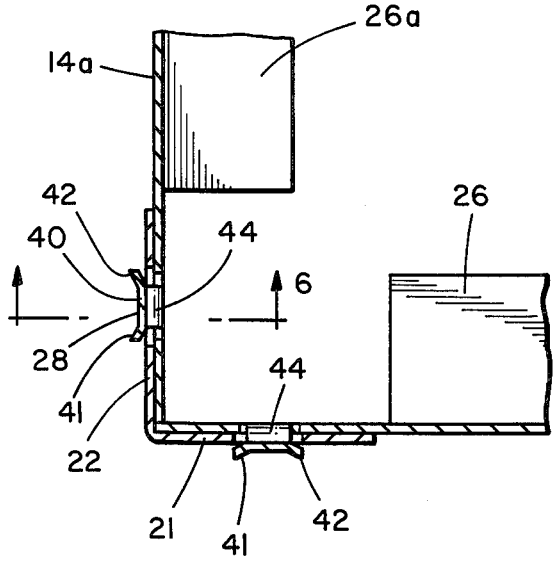
FIG. 5 is a sectional view taken along line 5—5 of FIG. 2.

As best shown in FIGS. 3 & 5, the shelf forming wall portion 26 does not extend all the way to the end of the beam but rather extends to the flange 38. In this way when the edges of the beams 14 and 14*a* are in juxtaposed adjacent relationship to each other at the inside corner of the L-shaped post 12, a square area of space is provided between the shelf forming wall portion 26 of the beam 14 and a similar shelf forming wall portion 26*a* of the beam 14*a*.

In FIGS. 7–11, there is illustrated another embodiment of the storage rack assembly of the present invention which is generally identified by the reference numeral 110 and includes corner posts 112, beams 114 and 114*a* and shelf panels 116. Each post 112 includes two supporting wall portions 121 and 122 which are integral with each other and which extend from each other at right angles to form the post 112 with an L-shaped cross section. However, one supporting wall, namely, supporting wall 122 is wider than the supporting wall 121.

Each beam 114, 114*a* includes a vertically disposed wall portion 124 and two horizontally disposed shelf forming wall portions 126 and 127 which are integral with and extend from the lower and upper edges, respectively, of the wall portion 124. The beams 114 and 114*a* are secured to the walls 121 and 122 of the post 112 by means of tabs 128 which are received through openings 130 in the wall portions 121 and 122 of the post 112. However, in this embodiment, each beam 114 and 114*a* has two tabs struck from each end of the wall portion 124 of the beam 114 or 114*a* and the openings 130 in the supporting walls 121 and 122 are spaced apart a greater distance than the openings 30 in the wall portions 21 and 22 shown in FIGS. 2, 3 & 4 so that each adjacent pair of openings 130 are adapted to receive a pair of tabs 128 struck from the end of the wall portion 124 of one of the beams 114 or 114*a*. In other respects, the openings 130 are identical to the openings 30 and the tabs 128 are identical to the tabs 28.

Figure 9:
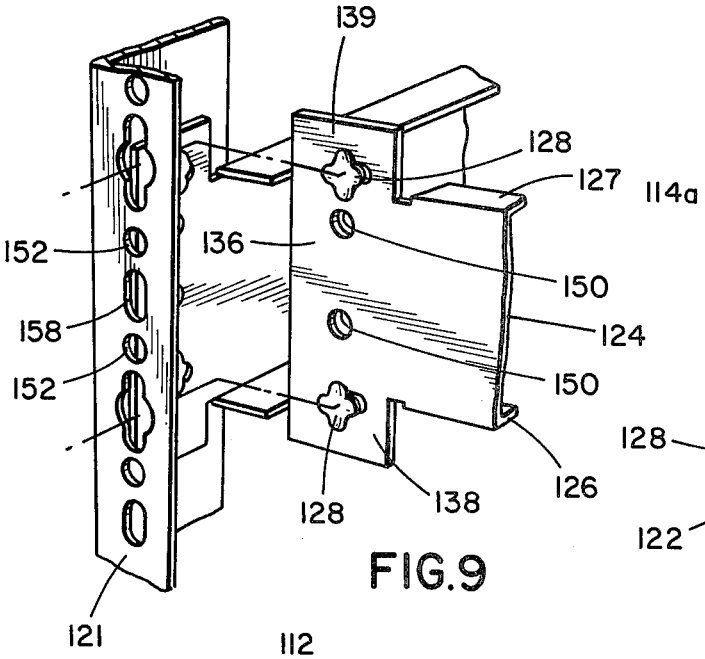
FIG. 9 is a fragmentary perspective view of the corner shown in FIG. 8 but rotated 90° and with one beam shown in exploded relationship to the post.

As best shown in FIG. 9, the beam 114 is different from the beam 14 by having not only two shelf forming wall portions 126 and 127 but also by having an end portion 136 which has a lower flange 138 and an upper flange 139 which extend therefrom. Also the tabs 128, instead of being struck from the end portion 136, are struck from the flanges 138 and 139.

Figure 8:
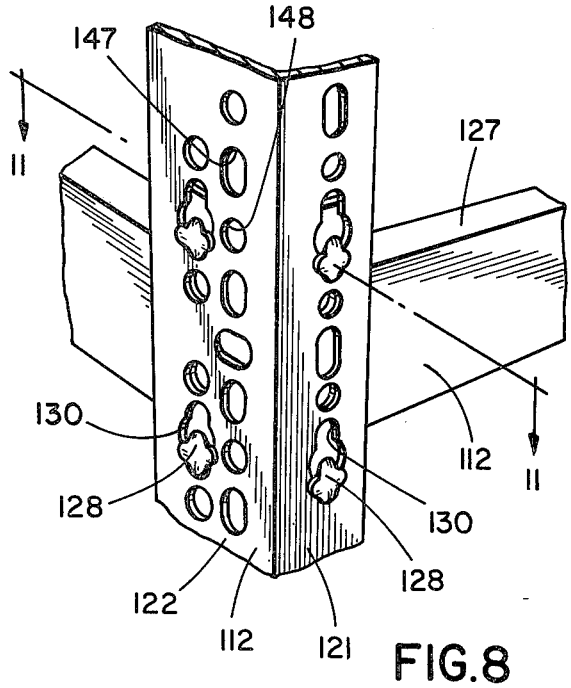
FIG. 8 is a fragmentary enlarged perspective view of a corner of the assembly shown in FIG. 7 and showing the connection between a post and two beams.
Figure 11:
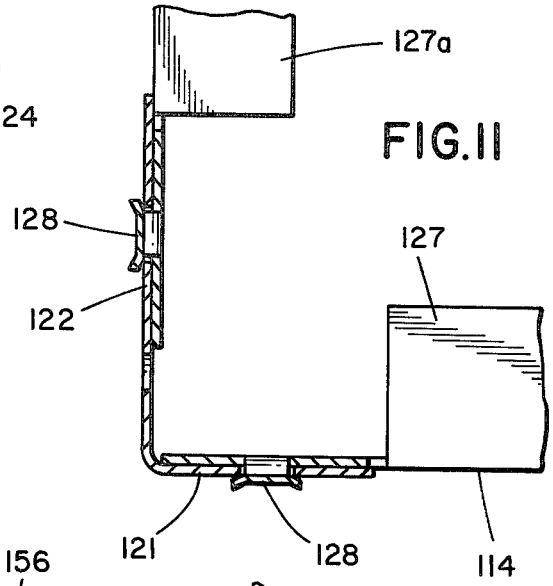
FIG. 11 is a sectional view taken along line 11—11 of FIG. 8.
Figure 10:
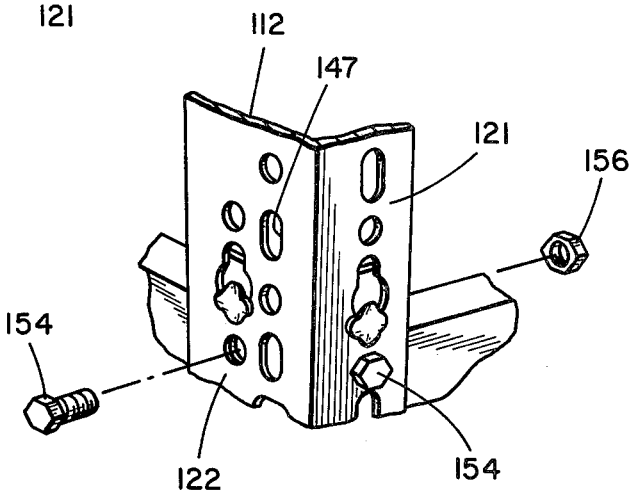
FIG. 10 is a fragmentary perspective view similar to FIG. 8 and showing the use of fasteners received through aligned holes in the beams and post to provide additional securement between the beams and post.

Additionally, in this embodiment and as best shown in FIGS. 8 & 11, the openings 130 in the supporting wall 122 are spaced a further distance from the junction between the walls 121 and 122 than are the openings 130 in the wall 121. This permits the formation of additional oval and circular holes 147 and 148 in the supporting wall 122 for any desired purpose. Also, with this arrangement, the end of the beam 114*a* will be spaced a further distance from the junction of the supporting walls 121 and 122 than is the end of the beam 114 as shown in FIG. 11.

In this embodiment, the end portion 136 is provided with two circular holes 150 which, when the tabs 128 are received in a pair of openings 130 and then locked in place, are aligned with and mate with similarly shaped circular holes 152 in one of the supporting walls 121 or 122 of the post 112 as shown. This permits insertion of two fasteners such as bolts 154 through two pairs of aligned holes 150 and 152 each of which bolts 154 can then be secured in place by a nut 156. Also in this embodiment, there is provided oval shaped holes 158 between each pair of circular holes 152 in the wall portion 121.

With the construction of the beams 114, 114*a* and posts 112 in the manner just described, the provision of two pairs of mating, interconnecting and interlocking tabs 128 and openings 130 provide a stronger interconnection, each with three points of contact, between each beam 114 or 114*a* and one of the supporting walls 121 or 122 of the post 112.

From the foregoing description it will be apparent that the storage rack assembly of the present invention has a number of advantages, some of which have been described above and others of which are inherent in the invention. Also, obvious modifications can be made to the storage rack assembly and particularly to the frame members, i.e., posts 12 and 112 and beams 14, 14*a*, 114 and 114*a* as well as to the locking tabs 28 or 128 and the mating openings 30 or 130 as well as their numbers and arrangement as clearly shown by the two embodiments illustrated in the accompanying drawings and described above. Accordingly, the scope of the invention is only to be limited as necessitated by the accompanying claims.

I claim:

1. In a storage rack assembly comprising at least one part of sheet metal or the like having at least one supporting wall with a front face and a back face, at least one opening in said supporting wall, at least one, one-piece beam of sheet metal or the like having an elongate wall portion with a front face and a back face and at least one load carrying tab struck from the wall portion adjacent one end of said beam and projecting from one face thereof, said tab being received in said opening with said beam extending transversely of said post, the improvement residing in said opening being wider in the central area thereof between opposite ends of said opening, which ends lie on a line which is co-axial with the elongate axis of said post, said tab having a central portion spaced outwardly from said one face of said wall portion and a connecting portion defined by two short arms which are integral with and extend, respectively, from opposite sides of said central portion to said wall portion and are integral with said wall portion, said central portion having at least one edge extending outwardly therefrom and transversely of said connecting portion and, when said beam is connected to said post, said central portion is received through said central area of said opening and then moved in a line co-axial with the elongate axis of said post to place one of said arms in one of said ends of said opening with said edge positioned over one face of said wall of said post.

2. The assembly according to claim 1 wherein said central portion of said tab has a second edge extending outwardly therefrom and transversely of said connecting portion, said two edges forming opposed locking ears which extend along a line that is co-axial to the elongate axis of said beam and that extends transversely of the elongate axis of said post when said tab is received in said opening and locked in place with said opposed ears extending over one face of said wall of said post.

3. The assembly according to claim 1 wherein said arms of said connecting portion extend angularly from said wall portion of said beam toward each other and to said central portion.

4. The assembly according to claim 1 wherein said wall portion of said beam adjacent the end of said beam has a hole therein and said wall of said post also has a hole therein spaced a predetermined distance from said opening and located so that when said tab is received and locked in place in said opening, said respective holes in said post and said beam are aligned so as to be capable of receiving a fastener therethrough.

5. The assembly according to claim 4 wherein said end of said beam has a flange extending laterally therefrom, forming a part of and being integral with said wall portion, and said hole is located in said flange.

6. The assembly according to claim 5 wherein said beam has an L-shaped cross section, one leg of said L forming said wall portion and having said flange depending therefrom adjacent one end thereof and the other leg forming a shelf portion for receiving and supporting a shelf panel of said assembly.

7. The assembly according to claim 1 wherein said end of said beam has two of said tabs struck therefrom, said tabs, being spaced apart and lying on a line which is transverse to the elongate axis of said beam, and wherein said post has two of said openings therein which are spaced apart and lie on a line co-axial with the elongate axis of said post and in position to receive, and have locked therein, said tabs.

8. The assembly according to claim 7 wherein said end of said beam has two spaced apart holes in said wall portion thereof which also lie on the line containing said tabs and wherein said wall of said post has at least two holes therein which are located between said openings and which lie on said line containing said openings and spaced so as to be in alignment with said holes in said beam when said tabs are received in said openings and locked in place.

9. The assembly according to claim 7 wherein said end of said beam has two oppositely extending flanges which extend outwardly of said beam and transversely of the elongate axis of said beam, said flanges being integral with said wall portion and each of said tabs being struck from one of said flanges.

10. The assembly according to claim 7 wherein said beam has a generally U-shaped cross section with said wall portion of said beam forming the bight of the U and two wall portions forming the legs of the U and being capable of receiving a shelf panel therebetween.

11. The assembly according to claim 1 wherein said post has a second wall integral with said first wall, said walls forming an L and said second wall having at least one opening therein which is configured the same as and is aligned with said opening in said first wall.

12. The assembly according to claim 11 wherein said second wall of said post is wider than said first wall and the opening in said second wall is located a further distance from the junction between said walls than is the opening in said first wall.

13. The assembly according to claim 11 wherein each wall of said post has a plurality of spaced apart openings therein with the openings in one of said walls being aligned with the openings in the other of said walls.

14. The assembly according to claim 13 wherein each opening in said first wall of said post is spaced a predetermined distance from the junction between said walls of said post and each aligned opening in said second wall of said post is spaced substantially the same distance from the junction between said walls.

15. The assembly according to claim 11 including a plurality of said beams and at least four of said posts and wherein each one of said beams has a flange at each end thereof integral with said wall portion and at least one shelf forming wall portion extending transversely from and integral with said wall portion, said tabs being struck from said flanges.

16. The assembly according to claim 15 wherein said beam has an elongate shelf forming wall portion which extends outwardly from and transversely of, and is integral with, said wall portion.

17. The assembly according to claim 1 wherein each of said beams has at least one tab at each end thereof.

* * * * *

UNITED STATES PATENT AND TRADEMARK OFFICE

CERTIFICATE OF CORRECTION

PATENT NO. : 4,106,630

DATED : August 15, 1978

INVENTOR(S) : Phillip Rosenband

It is certified that error appears in the above-identified patent and that said Letters Patent are hereby corrected as shown below:

Column 3, line 28, "openig" should read -- opening --.

Column 5, line 60, "part" should read -- post --.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*